US008789555B2

(12) United States Patent
Ball et al.

(10) Patent No.: US 8,789,555 B2
(45) Date of Patent: Jul. 29, 2014

(54) MOUNTING SYSTEM FOR HOT AND COLD WALL FAUCETS

(75) Inventors: William T. Ball, Colorado Springs, CO (US); Eric Pilarczyk, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 590 days.

(21) Appl. No.: 13/045,045

(22) Filed: Mar. 10, 2011

(65) Prior Publication Data

US 2011/0220221 A1 Sep. 15, 2011

Related U.S. Application Data

(60) Provisional application No. 61/312,483, filed on Mar. 10, 2010.

(51) Int. Cl.
*E03C 1/042* (2006.01)

(52) U.S. Cl.
USPC ..... 137/359; 137/360; 4/695

(58) Field of Classification Search
CPC ..... E03C 1/04; E03C 1/0401; E03C 1/0402; E03C 1/042; E03C 1/048
USPC ..... 137/356–360, 377, 801; 4/675–678, 4/695
See application file for complete search history.

(56) References Cited

U.S. PATENT DOCUMENTS

| | | | | |
|---|---|---|---|---|
| 1,278,895 A | | 9/1918 | Farley | |
| 1,414,792 A | | 5/1922 | Seither | |
| 1,556,241 A | | 10/1925 | Mueller | |
| 2,441,292 A | * | 5/1948 | Schroeder et al. | 137/350 |
| 3,088,484 A | * | 5/1963 | Marsh | 137/360 |
| 3,470,901 A | * | 10/1969 | Nisley | 137/360 |
| D239,448 S | | 4/1976 | Kazienko et. al | |
| 4,206,779 A | | 6/1980 | Sandstrom | |
| 4,366,866 A | | 1/1983 | Sweeney | |
| D270,090 S | | 8/1983 | Jennings | |
| 4,473,244 A | | 9/1984 | Hill | |
| 4,490,954 A | | 1/1985 | Cresti | |
| 4,553,561 A | * | 11/1985 | Morris | 137/362 |
| 4,863,201 A | | 9/1989 | Carstens | |
| 4,989,278 A | | 2/1991 | Kostorz | |
| 5,033,777 A | | 7/1991 | Blenkush | |
| 5,050,632 A | | 9/1991 | Means, Jr. | |
| 5,316,041 A | | 5/1994 | Ramacier et al. | |

(Continued)

FOREIGN PATENT DOCUMENTS

| | | | |
|---|---|---|---|
| FR | 2926571 | * | 7/2009 |
| JP | 2005-54387 | | 3/2005 |

OTHER PUBLICATIONS

"Hose Bib Supporter," PerfectSett Product Sheet, 2006, p. 1.

(Continued)

*Primary Examiner* — John K Fristoe, Jr.
*Assistant Examiner* — Jonathan Waddy
(74) *Attorney, Agent, or Firm* — Sheridan Ross P.C.

(57) ABSTRACT

A system for interconnecting a faucet assembly to a wall member is provided that employs a mounting bracket for interconnection to the wall member. The mounting bracket is configured to accommodate various configurations of faucets with any number of fluid delivery tubes. The mounting system provides structural rigidity to the faucet/building interconnection while minimizing occupation of interior wall space.

14 Claims, 16 Drawing Sheets

(56) References Cited

U.S. PATENT DOCUMENTS

| | | | |
|---|---|---|---|
| 5,381,826 | A | 1/1995 | Franz |
| 5,535,776 | A | 7/1996 | Kingman |
| 5,577,530 | A | 11/1996 | Condon |
| 5,582,199 | A | 12/1996 | Schmidt et al. |
| 5,803,508 | A | 9/1998 | Lowella |
| D408,895 | S | 4/1999 | Lai |
| 5,906,401 | A | 5/1999 | Viegener |
| 5,996,295 | A | 12/1999 | Merkle |
| 6,065,491 | A | 5/2000 | Rider |
| 6,142,172 | A | 11/2000 | Shuler et al. |
| 6,195,818 | B1 | 3/2001 | Rodstein et al. |
| D450,814 | S | 11/2001 | Aldred et al. |
| 6,360,770 | B1 | 3/2002 | Buchner et al. |
| 6,389,756 | B1 | 5/2002 | Oberdorfer |
| 6,394,125 | B2 | 5/2002 | White |
| 6,431,204 | B1 | 8/2002 | Ball |
| D477,385 | S | 7/2003 | Hampton |
| D478,652 | S | 8/2003 | Lai |
| D510,131 | S | 9/2005 | Karasawa |
| 6,948,518 | B1 | 9/2005 | Ball |
| 7,040,670 | B2 | 5/2006 | Madden |
| 7,055,863 | B1 | 6/2006 | Commeville et al. |
| D586,880 | S | 2/2009 | Gaston et al. |
| D612,021 | S | 3/2010 | Schmidt |
| D622,348 | S | 8/2010 | Gaston et al. |
| D631,139 | S | 1/2011 | Ball et al. |
| D631,140 | S | 1/2011 | Ball et al. |
| D631,141 | S | 1/2011 | Ball et al. |
| D633,988 | S | 3/2011 | Ball et al. |
| D637,696 | S | 5/2011 | Ball et al. |
| D641,833 | S | 7/2011 | Ball |
| 2004/0035064 | A1 | 2/2004 | Kugler et al. |
| 2006/0231140 | A1 * | 10/2006 | McNerney ..... 137/360 |
| 2007/0157981 | A1 | 7/2007 | Burns et al. |
| 2009/0007971 | A1 | 1/2009 | Ball |
| 2009/0211021 | A1 | 8/2009 | Gabriele |
| 2010/0116359 | A1 | 5/2010 | Ball et al. |
| 2010/0180375 | A1 | 7/2010 | Meehan et al. |

OTHER PUBLICATIONS

Advertisement entitled, "InBox™ For New Brick Weatherproof in Use Box with Protective Adapter Sleeve," Arlington Industries, Inc., 2006, 1 page.

Official Action for Canadian Patent Application No. 2,636,578, dated Sep. 24, 2010.

Official Action for Canadian Patent Application No. 2,636,578, dated May 6, 2011.

Official Action for U.S. Appl. No. 12/115,223, mailed Apr. 22, 2011.

Official Action for Canadian Patent Application No. 2,733,626 dated Jan. 11, 2013, 3 pages.

* cited by examiner

MOUNTING SYSTEM FOR HOT AND COLD WALL FAUCETS

This application claims the benefit of U.S. Provisional Patent Application Ser. No. 61/312,483, filed Mar. 10, 2010, the entire disclosure of which is incorporated by reference herein. This application is also related to U.S. Published Patent No. 20090007971, filed May 5, 2008, U.S. patent application Ser. No. 29/333,698, filed Mar. 13, 2009, U.S. Patent Application Publication No. 20100116359, filed Dec. 29, 2009, U.S. Design Pat. No. D631,139, filed Jan. 18, 2011, U.S. Design Pat. No. D631,140, filed Jan. 18, 2011, U.S. patent application Ser. No. 29/383,460, filed Jan. 18, 2010, U.S. Design Pat. No. D633,988, filed Mar. 8, 2011, and U.S. Design Pat. No. D631,141, filed Jan. 18, 2011, the entire disclosures of which are incorporated by reference herein.

FIELD OF THE INVENTION

Embodiments of the present invention are generally related to a mounting system for securing a faucet to a building surface. More specifically, one embodiment of the present invention is a mounting system for securing a faucet that is capable of delivering hot water, cold water, or a combination thereof to an interior wall comprised of dry wall.

BACKGROUND OF THE INVENTION

Wall faucets are often mounted with fasteners directly to an interior building surface, such as drywall. Thus an installer must exercise care so not to damage the interior building surface, which increases the time and cost of installation. Regardless of the standard of care exercised during installation, damage to the interior building surface is a common problem after installation.

More specifically, normal use of the faucet, and often an interconnected hose, generates loads on the fasteners that secure the faucet to the building surface which eventually damage the interior building surface. For example, when an interconnected hose is moved or pulled, the loads exerted on the faucet are reacted by the fasteners and transferred to the wall surface. Continued loading of the fasteners will eventually cause the fasteners to damage the wall surface and weaken the connection between the faucet and the interior building surface. Ultimately, the forces may cause the faucet to dislocate from the interior building surface, perhaps permanently damaging the building surface. Separation of the faucet from the interior building surface may also cause the faucet to disconnect from fluid supply tube(s) that are interconnected to the faucet.

Some devices currently used to secure a faucet to an interior building surface comprise a housing with a mounting surface that is recessed relative to the building surface. These devices are commonly found associated with washing machines and also include an outwardly protruding lip that directly abuts to the building surface. As the lip is interconnected directly to the building surface, the potential for wall damage described above remains a concern. Another drawback of the prior art mounting scheme is that the faucet handle or handles are disposed within the housing and recessed relative to the building surface and are thus difficult to access by some users. An example of a device that employs this mounting technique is provided in U.S. Pat. No. 5,050,632 to Means, Jr.

Thus it is a long felt need to provide a device that provides an attachment location for a wall faucet that minimizes the risk of damage to the surface to which the faucet is interconnected, minimizes the use of interior wall space, and is aesthetically pleasing. The following disclosure describes an improved system for interconnecting a wall faucet to an interior surface of a building that addresses and overcomes the problems described above and those other problems that would be understood by those of skill in the art.

SUMMARY OF THE INVENTION

It is one aspect of the present invention to provide a mounting system that supports a faucet assembly. More specifically, embodiments of the present invention employ a mounting bracket, which is adapted for interconnection to a wall member, that accommodates a faucet and an associated fluid supply line. One embodiment of the contemplated mounting system provides a stable interface between the faucet and the building surface. The bracket of embodiments of the present invention is designed to be mounted to the internal studs of a wall and thus eliminates the prior art issues associated with interconnecting a faucet directly to a building surface, such as drywall.

It is another aspect of the present invention to provide a faucet mounting system that can accommodate a faucet with multiple fluid inlets. Such faucets generally include separate handles, one associated with a hot water fluid inlet and one associated with a cold water inlet. One of skill in the art will appreciate that faucets having a single fluid inlet can be accommodated by the contemplated bracket.

It is another aspect of the present invention to provide a mounting system that can be installed quickly and easily. More specifically, embodiments of the present invention provide a mounting bracket that may be installed before or after an interior building surface is installed. It follows that the mounting bracket may be secured to internal wall members by framers or drywall installers. Guess work as to the most desirable mounting location for the faucet is thus reduced. Additionally, the faucet may be interconnected to the mounting bracket before finishing plates are installed (which will be described below), thereby providing enhanced access to the faucet so that plumbers are able to perform pressure checks and make final adjustments to the fluid connections associated with the faucet. Furthermore, embodiments of the present invention provide a mounting system that can be oriented horizontally or vertically so as to accommodate hydrants of various types. It follows that the contemplated mounting bracket may be interconnected to either horizontal or vertical wall support members.

It is another aspect of the present invention to provide a mounting system that minimizes the penetration into an interior wall space. More specifically, embodiments of the present invention provide a mounting bracket that, once installed, is flush with the interior building surface and protrudes minimally into the space between adjacent wall studs. Thus, unlike some prior art devices, the mounting system provides stability to the faucet without reducing volume with the wall that could alternatively accommodate electrical wires, insulation, pipes, etc.

It is still yet another aspect of the present invention to provide a mounting system that can accommodate different types, makes or models of faucets. More specifically, embodiments of the present invention provide a mounting bracket having penetrations that accommodate the pressure fluid inlet tubes associated with the faucet. As the location of fluid inlet tubes varies from manufacturer to manufacturer, the bracket of one embodiment employs apertures of an increased diameter so that many faucet types may be supported. If the faucet ports do not align with the fluid delivery tubes, quick adjustments of the mounting bracket are possible so that extensive structural modifications may be avoided.

It is yet another aspect of the present invention to provide a mounting system that is aesthetically pleasing. More specifically, finishing plates may be provided that interconnect to the mounting bracket to conceal gaps between the mounting bracket and the abutting interior building surface. A flange associated with a wall faucet covers an aperture(s) in the mounting bracket through which the fluid delivery tube or tubes (as found on faucets with hot and cold water inlets) are passed. Further, the mounting and finishing plates of embodiments of the present invention may be made of any color to blend in with the color of the wall which adds to the aesthetically pleasing appearance of the finished assembly.

It is yet another aspect of the present invention to provide a mounting bracket that is constructed of common materials, such as plastic, steel, aluminum, rubber (or other flexible materials), vulcanized rubber, wood, or any other common building material that complies with applicable building codes. Preferably, the mounting plate and associated finishing plates are made of plastic, which is non-corrosive and provides the needed rigidity to secure the faucet assembly.

It is still yet another aspect of the present invention to provide a mounting bracket that is designed for heavy duty applications. More specifically, many industrial faucets include heavy duty flanges and heavier, bulkier faucet components. Additionally, larger hoses are often associated with industrial faucets which increase the potential of wall damage. Thus, various embodiments of the present invention employ a mounting bracket that accommodates the larger flanges generally associated with industrial faucets.

It is another aspect of embodiments of the present invention to provide a system for mounting a faucet, comprising: a mounting bracket having an upper edge, a lower edge, a left edge, and a right edge that define a front surface, said mounting bracket having at least one fluid inlet aperture that is adapted to accommodate a fluid inlet tube that is associated with the faucet, a plurality of bracket mounting apertures, and at least one faucet mounting aperture that is adapted to receive a fastener that is used to mount the faucet to said bracket, and said mounting bracket having a flange extending from a back surface of said mounting bracket; a first face plate for engagement onto a first portion of said front face; and a second face plate for engagement onto a second portion of said front face, wherein said first face plate and said second face plate conceal said bracket when said bracket is associated with a building surface.

It is still yet another aspect of embodiments of the present invention to provide a mounting bracket for supporting a faucet, comprising: a front surface and a back surface; at least one at least one fluid inlet aperture that is adapted to accommodate a fluid inlet tube that is associated with the faucet; a plurality of bracket mounting apertures; and at least one faucet mounting aperture that is adapted to receive a fastener that is used to mount the faucet to said bracket.

It is another aspect of embodiments of the present invention to provide a wall faucet associated with a building surface, comprising: a mounting bracket having an upper edge, a lower edge, a left edge, and a right edge that define a front surface, said mounting bracket having at least one fluid inlet aperture that is adapted to accommodate a fluid inlet tube that is associated with the faucet, a plurality of bracket mounting apertures, and at least one faucet mounting aperture that is adapted to receive a fastener that is used to mount the faucet to said bracket, and said mounting bracket having a flange extending from a back surface of said mounting bracket; wherein further comprising a raised portion that extends from said front surface around said at least one fluid inlet aperture; a faucet having a housing that accommodates a fluid outlet, a flange for supporting said faucet, and a fluid inlet tube, wherein said flange abuts an outer surface of said raised portion, thereby providing a gap between said flange and said front face; wherein said fluid inlet tube is received within said fluid inlet aperture; a first face plate for engagement onto a first portion of said front face; and a second face plate for engagement onto a second portion of said front face, wherein said first face plate and said second face plate conceal said bracket when said bracket is associated with a building surface.

The Summary of the Invention is neither intended nor should it be construed as being representative of the full extent and scope of the present invention. Embodiments of the present invention are set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of embodiments of the invention.

Figure 1:
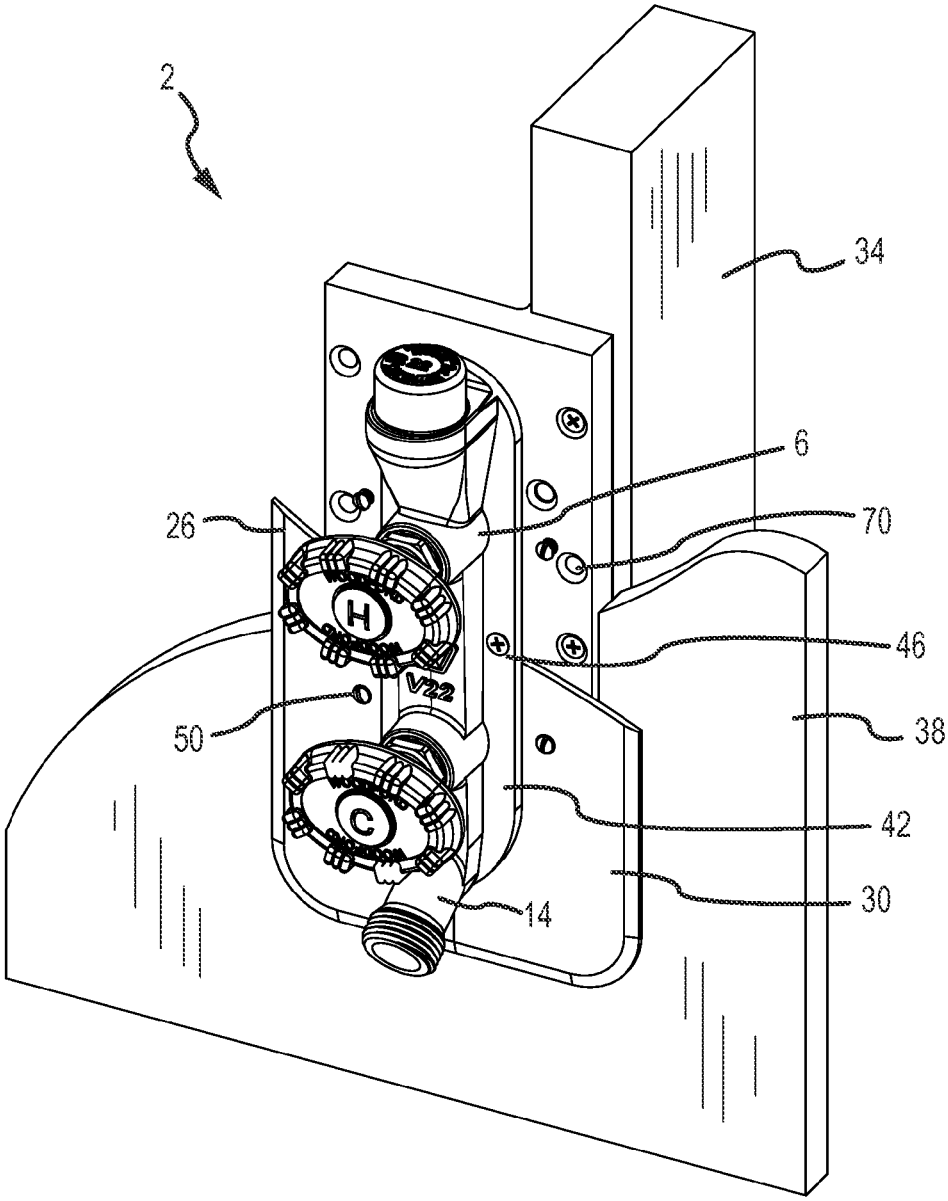
FIG. 1 is a front perspective view of a faucet mounting system according to one embodiment of the present invention that is interconnected to a vertical wall stud.

To assist in the understanding of the present invention, the following list of components and associated numbering found in the drawings is provided herein:

| # | Component |
|---|---|
| 2 | Faucet Mounting System |
| 4 | Mounting Bracket |
| 6 | Faucet Assembly |
| 14 | Faucet |
| 18 | Fluid Delivery Tube |
| 26 | First Finishing Plate |
| 30 | Second Finishing Plate |
| 34 | Wall Stud |
| 38 | Interior Building Surface |
| 42 | Flange |
| 46 | Aperture |
| 50 | Aperture |
| 54 | Aperture |
| 58 | Faucet Inlet Port |
| 62 | Flange |
| 66 | Aperture |
| 70 | Plurality of Apertures |
| 74 | Boss |
| 78 | Slot |
| 82 | Apertures |
| 86 | Boss |
| 90 | Abutting Interface |
| 94 | Front Surface |
| 98 | Front Surface |
| 102 | Chamfer |
| 106 | Back Surface |
| 110 | Back Surface |
| 114 | Front Surface |
| 118 | Back Surface |
| 122 | First Surface |
| 126 | Second Surface |
| 130 | Side Surface |
| 134 | Aperture |
| 138 | Radius |
| 142 | Flange |
| 146 | Flange |
| 150 | Open-ended Slot |
| 154 | Arcuate Surface |
| 158 | Open-ended Slot |
| 162 | Arcuate Surface |

It should be understood that the drawings are not necessarily to scale, but that relative dimensions nevertheless can be determined thereby. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring to FIGS. 1-19, a faucet mounting system 2 for securing a faucet assembly 6 to a building surface 38 is provided that includes a mounting bracket 4 that receives and secures the faucet assembly 6 and associated fluid delivery tubes 18. The mounting system 2 also includes a first finishing plate 26, and a second finishing plate 30 for connecting mounting bracket 4.

Generally, the faucet mounting system 2 of various embodiments of the present invention is installed in the following manner. Initially, the desired faucet location is identified. Then, the mounting bracket 4 is interconnected to an internal building member, such as a wall stud 34, with fasteners, the fluid delivery tubes 18 of the faucet assembly 6 are passed through the mounting bracket 4, and a faucet flange 42 is interconnected to the bracket 4 with fasteners. The faucet assembly 6 is then connected to the at least one fluid delivery tube 18. After the faucet assembly 6 is pressure tested and the interior building surface 38 is installed, the finishing plates are secured to the mounting bracket 4 by fasteners. The interior building surface 38 may include drywall, wood paneling, particle board, tile, or other similar building surfaces known in the art.

FIGS. 1-5 show the faucet mounting system 2 according to one embodiment of the present invention interconnected to an internal wall member 34 and associated with an interior building surface 38. A faucet assembly 6 includes the flange 42 that is interconnected to the mounting bracket 4. A first finishing plate 26 and a second finishing plate 30 are used to conceal the mounting bracket 4 and the interface between the mounting bracket 4 and the interior building surface 38. The finishing plates have apertures 50 that receive fasteners for interconnection to the mounting bracket 4. The faucet assembly 6 and the finishing plates interconnect to the mounting bracket 4 via fasteners, such as screws, that are received through apertures 46 and 50, respectively. The finishing plates can be interconnected to the mounting bracket 4 before or after interconnection of the faucet assembly 6 to the mounting bracket 4. Preferably, however, the location and configuration of the apertures 50 allows the finishing plates to be installed after the faucet assembly 6 is interconnected to the mounting bracket 4, which reduces the risk of damage to the finishing plates.

Figure 2:
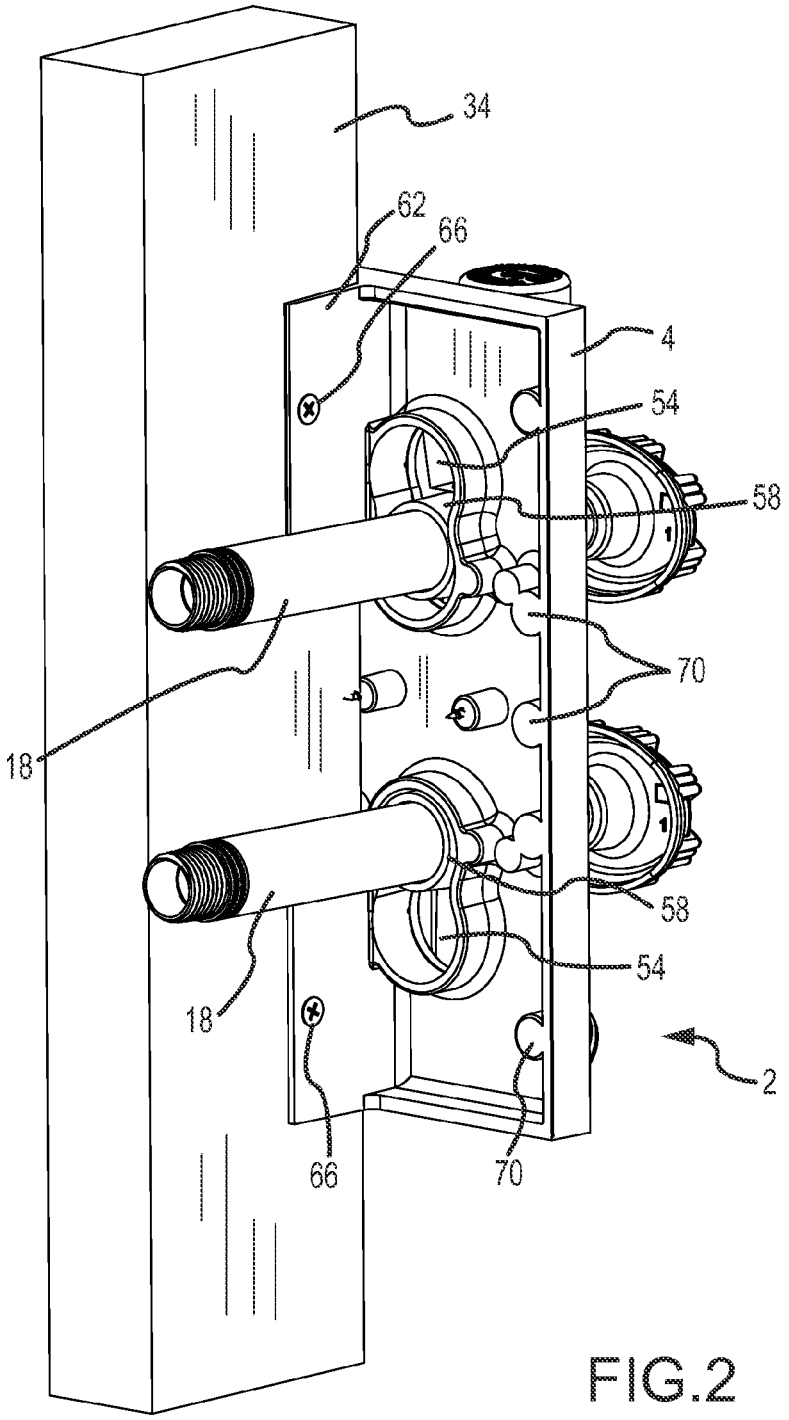
FIG. 2 is a rear perspective view of the faucet mounting system of FIG. 1.
Figure 3:
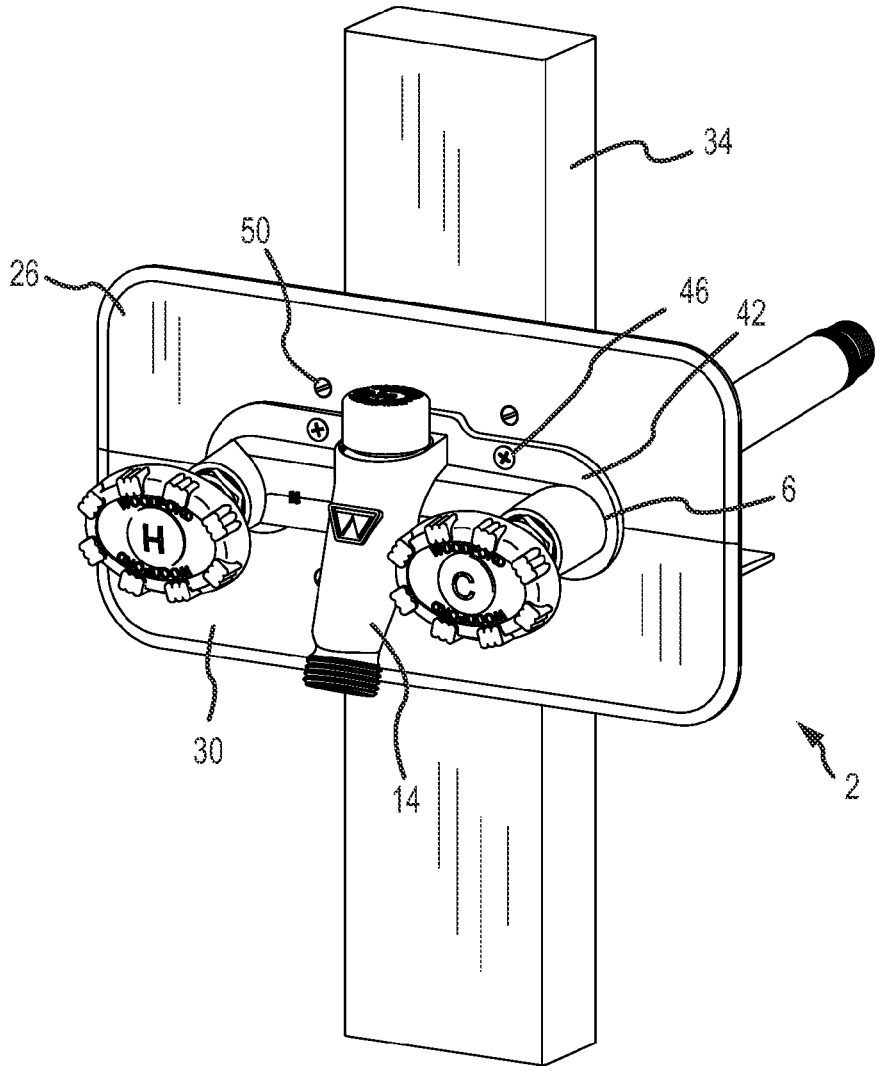
FIG. 3 is a front perspective view of a faucet mounting system that is interconnected a vertical wall stud.
Figure 4:
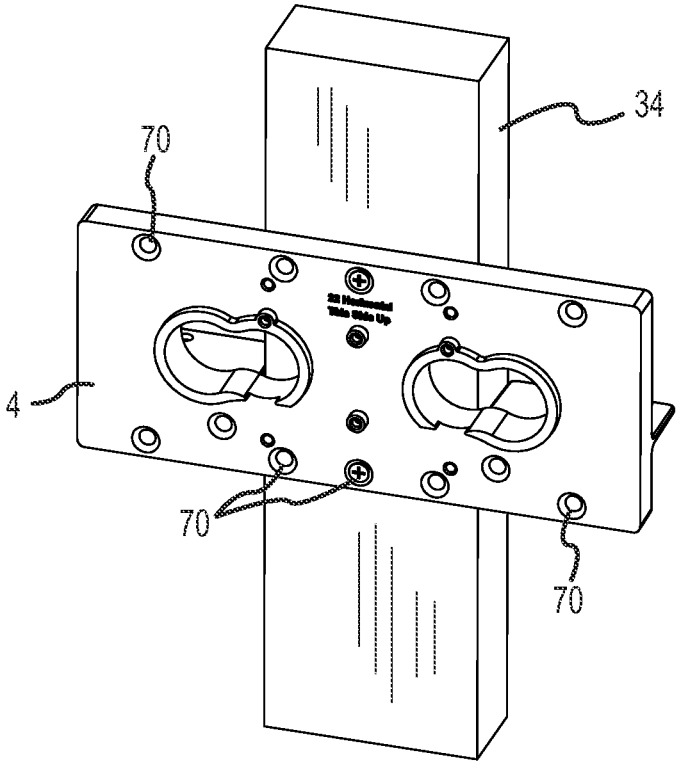
FIG. 4 is a front perspective view of the faucet mounting system of FIG. 3 wherein the faucet and finishing plates have been omitted for clarity.

FIG. 2 is a rear perspective view of the faucet mounting system 2 that shows the mounting bracket 4 abutting a portion of the interior building surface 38. The apertures 54 accommodate the faucet inlet ports 58 and/or fluid delivery tubes 18 and are configured so as to accommodate a variety of different types, makes or models of faucet assemblies 6. The mounting bracket 4 includes flanges 62 with an aperture 66 for receiving fasteners that connect the mounting bracket 4 to the wall stud 34. The mounting bracket 4 may have a plurality of apertures 70 (see FIG. 4, for example) for interconnection with the wall stud 34 to provide additional structural support. One of skill in the art will appreciate that the wall stud 34 shown in FIGS. 1 and 2 may be rotated ninety degrees about its vertical axis (see FIG. 3) without any impact on the functionality or stability of the faucet mounting system 2.

Figure 5:
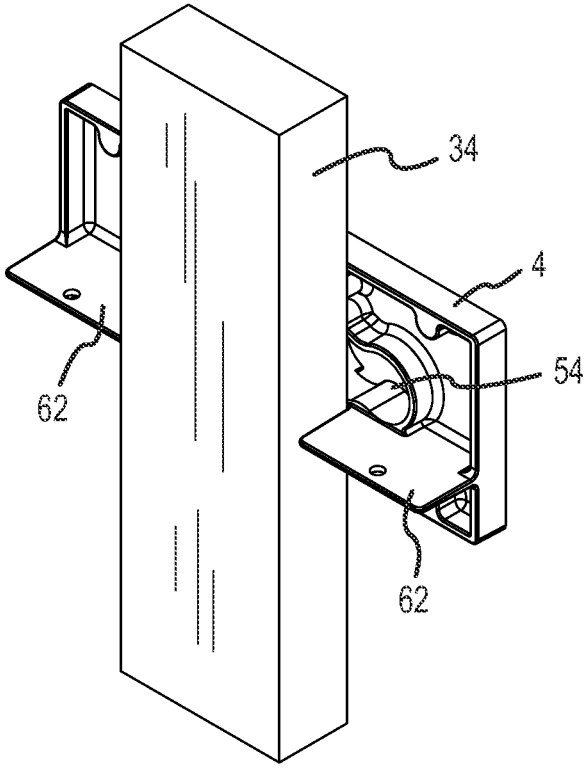
FIG. 5 is a rear perspective view of the faucet mounting system of FIG. 4.
Figure 6:
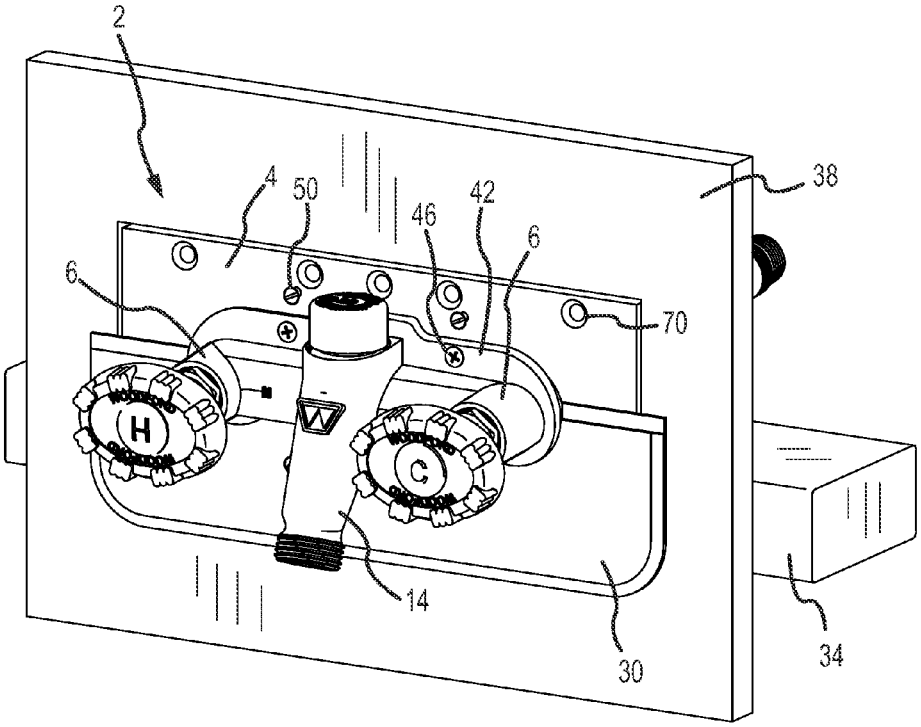
FIG. 6 is a front perspective view of a faucet mounting system according to one embodiment of the present invention that is interconnected to a horizontal wall stud wherein a first finishing plate has been omitted for clarity.

FIG. 5 is a rear perspective view of the mounting bracket 4. The orientation and configuration of the mounting bracket 4 enables the faucet mounting system 2 to accommodate a faucet assembly with horizontally disposed fluid delivery tubes 18 that are positioned on either side of the wall stud 34.

Referring now to FIGS. 6-12, a faucet mounting system 2 is shown in an alternate orientation so as to secure a faucet of another design. More specifically, a faucet assembly 6 is interconnected to a mounting bracket 4 that has been rotated 90° and is interconnected to a horizontally oriented wall stud 34. Similar to the faucet assembly 6 described above, the faucet 14 has a flange 42 with apertures 46 therethrough for interconnecting the faucet 14 to the mounting bracket 4. An interior building surface 38 surrounds the perimeter of the mounting bracket 4 and provides a substantially flush surface that is covered partially by the finishing plates. To interconnect the mounting bracket 4 to the wall stud 34, a plurality of fasteners are received within corresponding apertures 70 provided by the mounting bracket 4. First and second finishing plates 26 and 30 interconnect to the mounting bracket 4 via fasteners that pass through apertures 50. The location of the apertures 50 may be varied so as to accommodate faucet assemblies of different designs.

Figure 7:
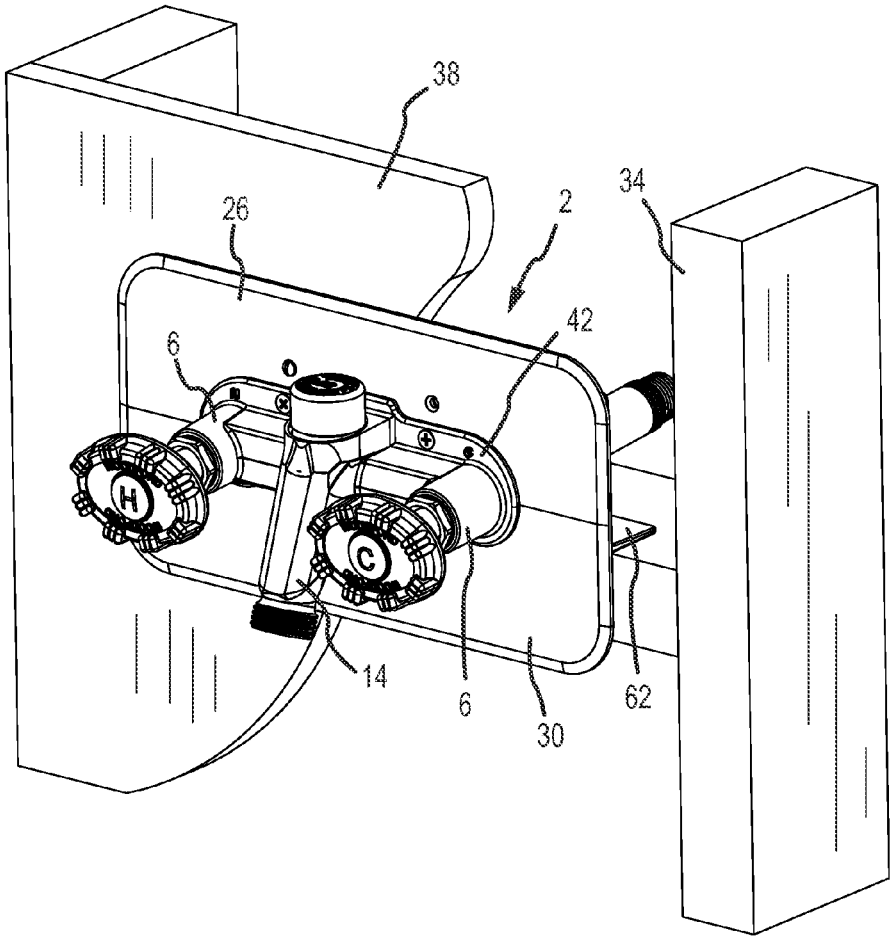
FIG. 7 is a front perspective view of the faucet mounting system of FIG. 6.

FIG. 7 shows a first finishing plate 26 and a second finishing plate 30 that are used to conceal the mounting bracket 4. The mounting bracket 4 has a plurality of apertures 70 for interconnecting the mounting bracket 4 to the wall stud 34. The plurality of apertures 70 include counterbores or counterfit holes for receiving the heads of fasteners that interconnect the mounting bracket 4 to the wall stud 34, which allows the finishing plates to be installed without contacting with the fastener heads. One of skill in the art will appreciate that the number, size, and location of the plurality of apertures 70 may vary and all the apertures do not need to be used.

Figure 8:
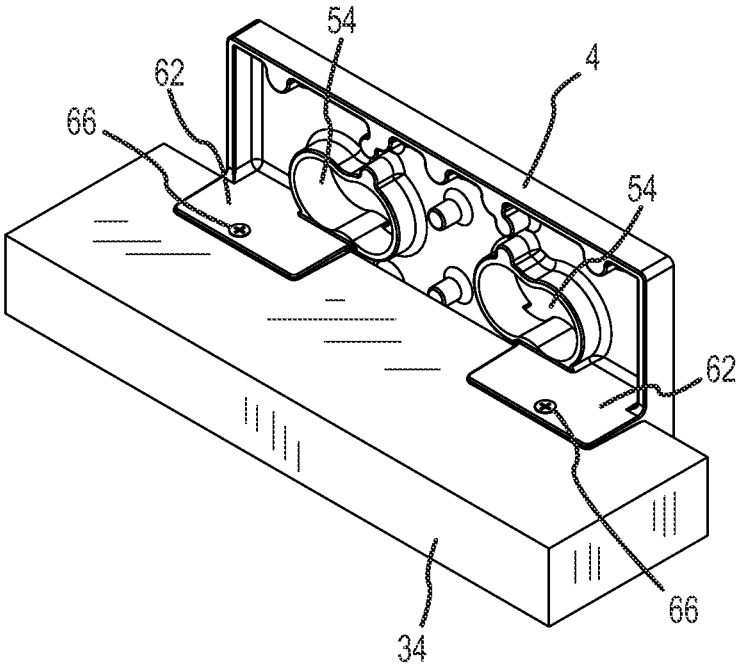
FIG. 8 is a top rear perspective view of the faucet mounting system of FIG. 6 wherein the finishing plates and an interior building surface have been removed for clarity.

As shown in FIG. 8, for example, the mounting bracket 4 may include flanges 62 that are used to abut the wall stud 34. The flanges 62 have apertures 66 for receiving fasteners, such as nails or screws, to secure the mounting bracket 4 to the wall stud 34. Additionally, the mounting bracket may include at least one aperture (similar to #70 as seen in FIG. 1, for example) for the receipt of additional mounting fasteners. Furthermore, as only the flanges 62 of the mounting bracket 4 protrudes into the interior wall space, the mounting bracket 4 does not occupy valuable interior wall space needed for electrical wiring, insulation, and fluid delivery tubes. That is, the majority of the mounting bracket 4 is coincident with the interior building surface 38.

Figure 9:
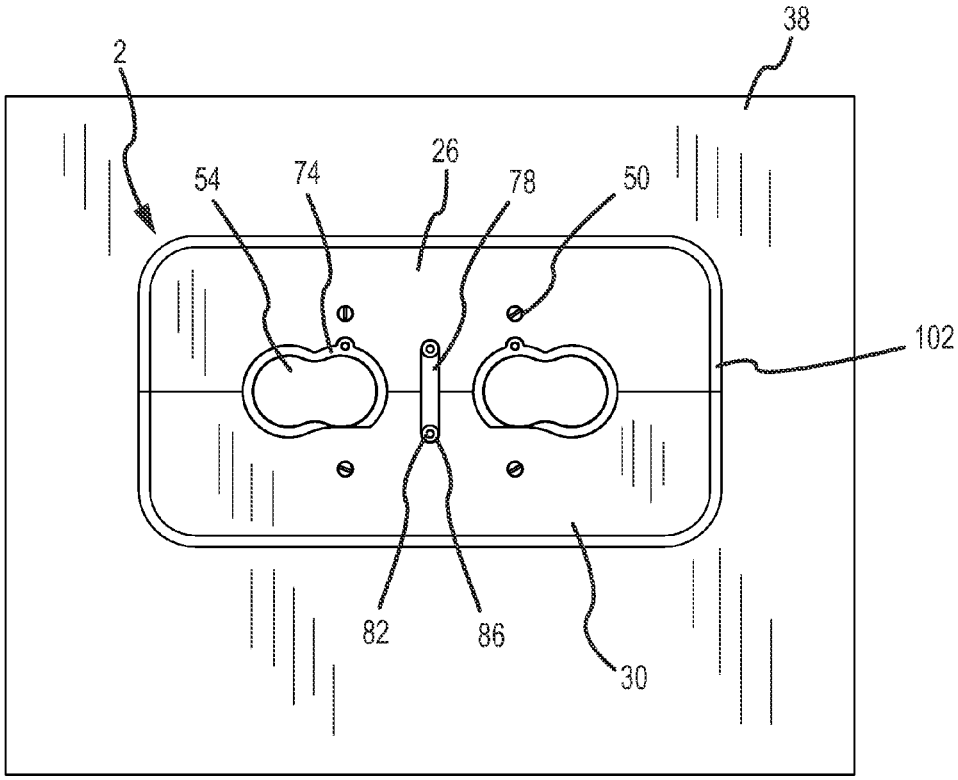
FIG. 9 is a front elevation view of a mounting system according to one embodiment of the present invention.

Referring to FIG. 9, the first finishing plate 26 abuts the second finishing plate 30 to conceal the mounting bracket. Further, the finishing plates are configured to abut and surround a boss 74 that extends from the apertures 54. The interconnected finishing plates 26 and 30 form a slot 78 that accommodates faucet mounting apertures 82 and associated bosses 86. The mounting apertures 82 provide interconnection points for securing the faucet assembly to the mounting bracket 4. The finishing plates have apertures 50 for interconnection to the mounting bracket 4.

Figure 10:
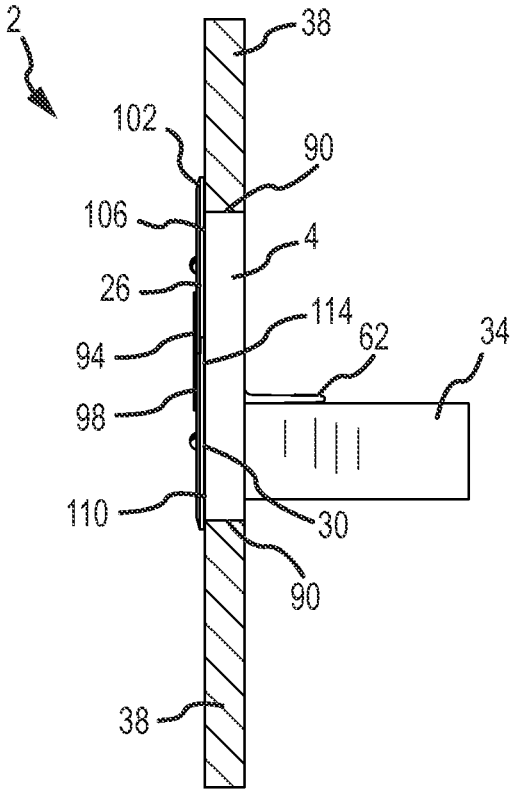
FIG. 10 is a side elevation view of the mounting assembly of in FIG. 9.
Figure 11:
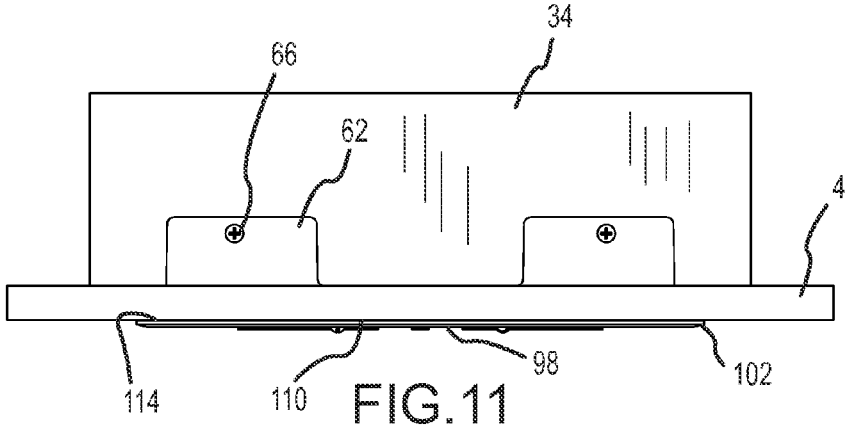
FIG. 11 is a top plan view of the mounting assembly of in FIG. 9.

FIG. 10 is a side view of the mounting system 2 shown in FIG. 9. The finishing plates conceal an abutting interface 90 between the interior building surface 38 and the mounting bracket 4. The bosses 74 and 86 (see FIG. 9) are sized to be flush with a front surface 94 of the first finishing plate 26 and front surface 98 of the second finishing plate 30 after installation. The edges of the finishing plates may be chamfered 102 to remove sharp edges and to provide an aesthetically pleasing appearance in which the surface of the finishing plates smoothly transition to the interior building surface 38. A back surface 106 of the first finishing plate 26 and a back surface 110 of the second finishing plate 30 abut the front surface 114 of the mounting bracket 4 and the interior building surface 38. The back surface 118 of the mounting bracket 4 abuts the wall stud 34. The thickness of the mounting bracket 4 is designed to correspond to the thickness of the interior building surface 38, thereby allowing both the mounting bracket 4 and the interior building surface 38 to interconnect to the wall stud 34 and to provide a substantially flush surface that is covered by the finishing plates.

The wall stud 34 may be positioned between flanges 62 and abuts back surface 118 of the mounting bracket 4. In this configuration, the flanges 62 assist in positioning the mounting bracket 4 in relation to the wall stud 34 but do not interconnect to the wall stud 34. Instead, fasteners interconnect the mounting bracket 4 to the wall stud 34 via a plurality of apertures 70 provided in the mounting bracket 4.

Figure 12:
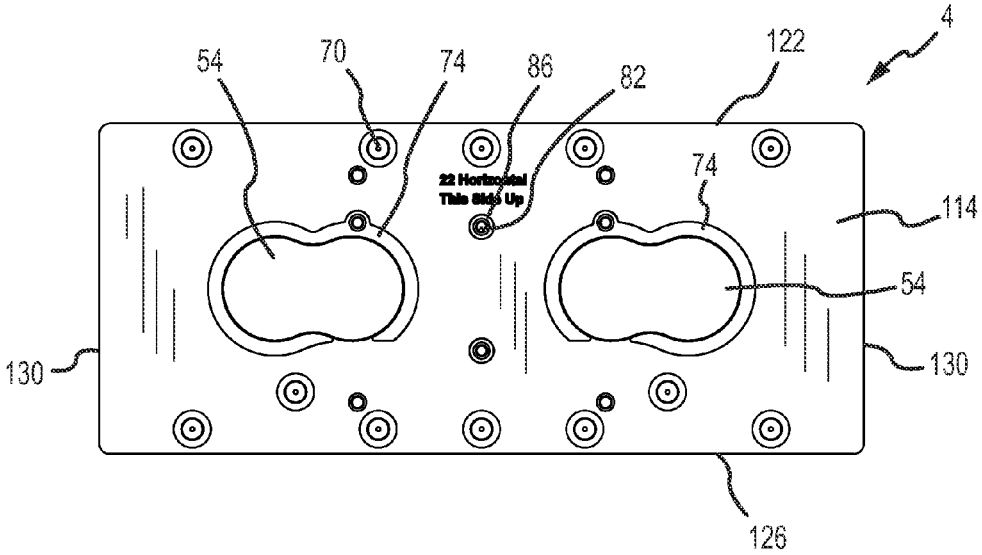
FIG. 12 is a front elevation view of a mounting bracket according to one embodiment of the present invention.
Figure 13:
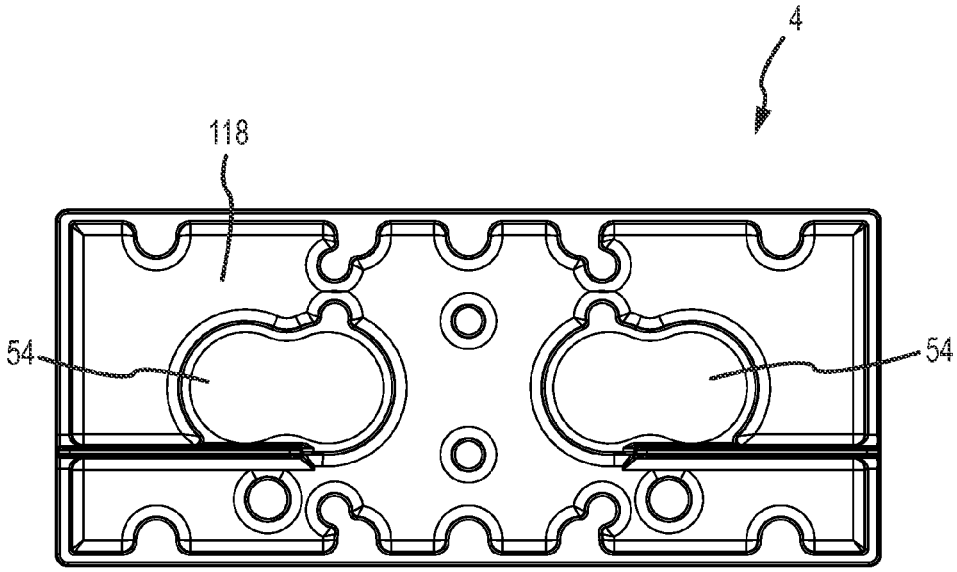
FIG. 13 is a rear elevation view of the mounting bracket shown in FIG. 12.
Figure 14:
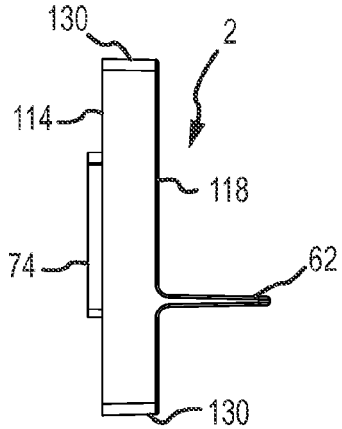
FIG. 14 is a side elevation view of the mounting bracket shown in FIG. 12.

Referring now to FIGS. 12-14, a mounting bracket 4 according to one embodiment of the present invention is shown. The mounting bracket 4 has two bosses 74 extruded around the perimeter of two apertures 54. The bosses 74 receive the faucet flange in an abutting relationship which offsets the faucet flange from a front face 114 of the mounting bracket. The gap provided between the faucet flange and the front face 114 of the bracket allows the finishing plates to be positioned behind the faucet flange and to abut the sides of the bosses 74. Each aperture 54 has a profile that resembles two overlapping circles and are thus able to accommodate faucets that have narrow and wide spaced faucet inlet ports and associated fluid delivery tubes. As should be apparent to one of skill in the art, the mounting bracket 4 is configured to be universal providing structural stability to various faucet types, makes or models while accommodating various orientations and configurations of internal wall members and fluid delivery tubes 18.

The mounting bracket 4 also has two bosses 86 and associated apertures 82 configured to provide a connection point for the faucet flange. Additionally, the plurality of apertures 70 are selectively positioned on the mounting bracket 4 to accommodate vertical and horizontal wall studs. The plurality of apertures 70 also include counterbore or countersink holes for housing the heads of fasteners used to interconnect the mounting bracket 4 to a wall stud 34, thus allowing finishing plates to be interconnected to the mounting bracket 4 without interference from the fasteners. The flange 62 also provides interconnection points to the wall stud 34.

Figure 15:
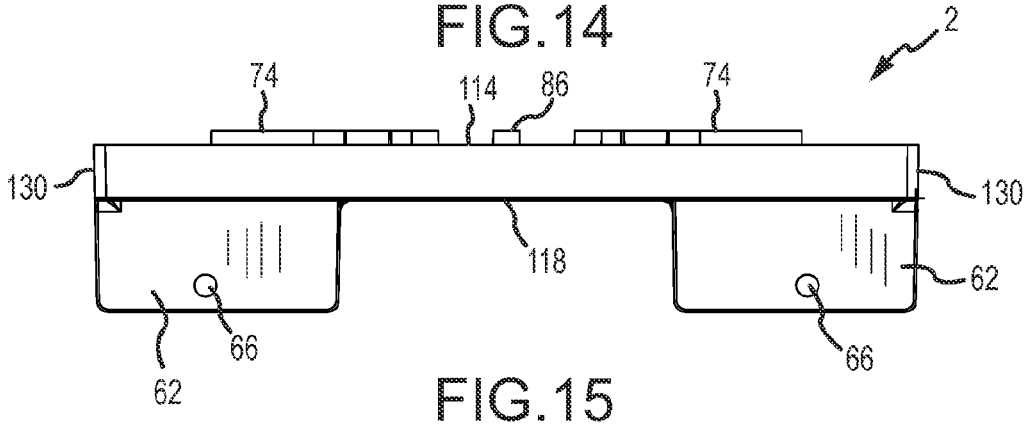
FIG. 15 is a bottom plan view of the mounting bracket shown in FIG. 12.

FIGS. 14 and 15 show bosses 74 and 86 that protrude from a front surface 114 of the mounting bracket 4 and the flange 62 protrudes from a back surface 118 of the mounting bracket 4. Again, the flange 62 is configured to provide additional interconnection points to the wall stud 34 and to reduce moment loads in fasteners used to interconnect the mounting bracket 4 to the wall stud 34 via the plurality of apertures 70. The flange 62 is not required and is an optional feature, such as for heavy use applications. The bosses may also protrude from the back surface 118 of the mounting bracket 4 to provide a positioning guide to prevent the fluid tube receiving apertures from being partially blocked by a wall stud 34 after the mounting bracket 4 is interconnected to the wall stud 34.

One of skill in the art will appreciate that the configuration of the mounting bracket 4 may be altered from that shown in figures. For example, the mounting bracket 4 may have more or less than two apertures 54 for passage of fluid delivery tubes 18, and the apertures 54 may vary in size and shape. The mounting bracket 4 may have any number of flanges 62 for interconnection to a wall stud 34, including no flanges 62. Additionally, the mounting bracket 4 may include various numbers, positions, and sizes of apertures for interconnecting the mounting bracket 4 to a finishing plate, a faucet 14, and an internal wall member as may be desired and/or needed. Furthermore, the mounting bracket 4 and associated features may be altered to accommodate different sizes of wall studs. Moreover, the mounting bracket 4 may be configured to interconnect to more than one internal wall member.

Figure 16:
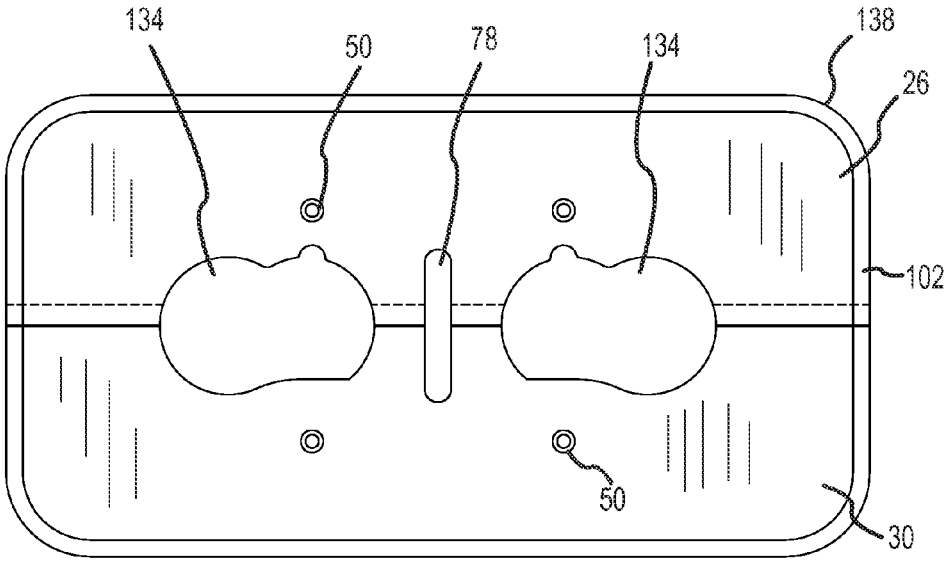
FIG. 16 is a front elevation view of finishing plates according to one embodiment of the present invention.
Figure 17:
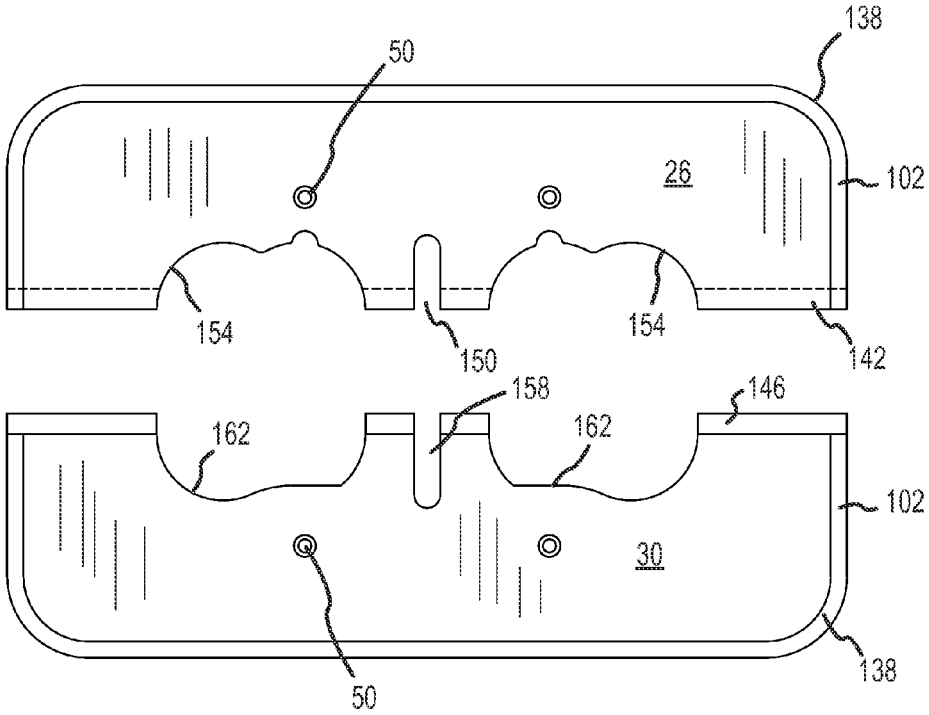
FIG. 17 is an exploded version of FIG. 16.
Figure 18:
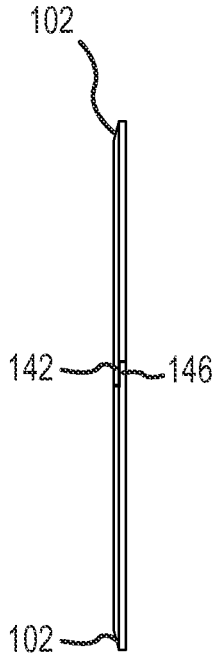
FIG. 18 is a side elevation view of the finishing plates shown in FIG. 16.
Figure 19:
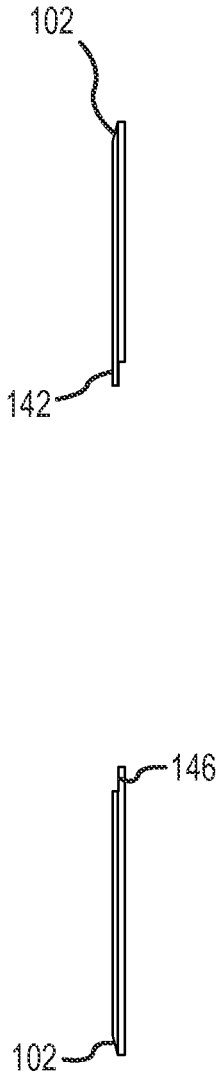
FIG. 19 is a side elevation view of the first finishing plate shown in FIG. 17.

FIGS. 16-19 illustrate finishing plates according to another embodiment of the present invention. FIG. 16 is a front view of a first finishing plate 26 interconnected with a second finishing plate 30. The assembled finishing plates provide two apertures 134 and a slot 78 to accommodate mounting bracket protrusion bosses. The finishing plates also have apertures 50 for interconnection to a mounting bracket. Additionally, the corners of the finishing plates have a radius 138 and the edges of the finishing plates include the chamfer 102 described above to provide a smooth transition to an interior building surface 38. As shown in FIGS. 17 & 19, the first finishing plate 26 has a flange 142 that intermeshes with a flange 146 of the second finishing plate 30. Alternatively, the finishing plates may have an abutting interface.

The first finishing plate 26 according to one embodiment of the present invention has an open-ended slot 150, an arcuate surface 154, and a flange 142. The second finishing plate 30 has a corresponding open-ended slot 158, arcuate surface 162, and flange 146. Once assembled, the corresponding features of the first finishing plate 26 and the second finishing plate 30 provide for a slot 78, an aperture 134, and a continuous chamfer 102. If a faucet assembly 6 is interconnected to a mounting bracket 4 before the finishing plates, the finishing plates are configured to be positioned on the mounting bracket 4 and then slid between a faucet flange and the front surface of the mounting bracket. Once the finishing plates abut the bosses and flange 142 intermeshes with the flange 146, fasteners interconnect the finishing plates to the mounting bracket 4 via finishing plate apertures 50. One of skill in the art will appreciate that any number of finishing plates may be utilized. For example, a single finishing plate with a hinge may be employed. The use of a hinge would allow the finishing plate to be pivotably opened for installation and then pivotably closed once positioned in place.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. In addition, one skilled in the art will appreciate that aspects of other inventions may be incorporated and are added in combination to the embodiments of the present invention disclosed herein.

What is claimed is:

1. A system for mounting a faucet, comprising:

a mounting bracket having an upper edge, a lower edge, a left edge, and a right edge that define a front surface, said mounting bracket having at least one fluid inlet aperture that is adapted to accommodate a fluid inlet tube that is associated with the faucet, a plurality of bracket mounting apertures, and at least one faucet mounting aperture that is adapted to receive a fastener that is used to mount the faucet to said bracket, and said mounting bracket having a flange extending from a back surface of said mounting bracket;

a first face plate for engagement onto a first portion of said front surface;

a second face plate for engagement onto a second portion of said front surface, wherein said first face plate and said second face plate conceal said bracket when said bracket is associated with a building surface; and a raised portion that extends from said front surface around said at least one fluid inlet aperture, said raised portion having an outer surface for receiving a flange associated with the faucet and a side edge that receives said first face plate and said second plate such that said first face plate and said second face plate are positioned between the faucet flange and said front surface.

2. The system of claim 1, wherein said at least one fluid inlet aperture is shaped as two overlapping circular holes.

3. The system of claim 1, wherein said mounting bracket possesses a thickness that corresponds with the thickness of a drywall panel.

4. The system of claim 1, wherein said at least one fluid inlet aperture comprises a first fluid inlet aperture that is adapted to receive a first fluid inlet tube and a second fluid inlet aperture that is adapted to receive a second fluid inlet tube.

5. A mounting bracket for supporting a faucet, comprising:

a front surface and a back surface;

at least one fluid inlet aperture that is adapted to accommodate a fluid inlet tube that is associated with the faucet;

a plurality of bracket mounting apertures;

at least one faucet mounting aperture that is adapted to receive a fastener that is used to mount the faucet to said bracket;

a raised portion that extends from said front surface around said at least one fluid inlet aperture, said raised portion having an outer surface for receiving a flange associated with the faucet and a side edge that receives a first face plate and a second face plate such that said first face plate and said second face plate are positioned between the faucet flange and said front surface; and wherein said at least one fluid inlet aperture comprises a first fluid inlet aperture that is adapted to receive a first fluid inlet tube and a second fluid inlet aperture that is adapted to receive a second fluid inlet tube.

6. The bracket of claim 5, further comprising a flange extending from said back surface.

7. The bracket of claim 5, wherein said at least one faucet mounting aperture is associated with a boss that extends away from said front surface.

8. The bracket of claim 5, wherein said at least one fluid inlet aperture is non-circular.

9. The bracket of claim 5, wherein said mounting bracket possesses a thickness that corresponds with the thickness of a drywall panel.

10. A wall faucet associated with a building surface, comprising:

a mounting bracket having an upper edge, a lower edge, a left edge, and a right edge that define a front surface, said mounting bracket having at least one fluid inlet aperture that is adapted to accommodate a fluid inlet tube that is associated with the faucet, a plurality of bracket mounting apertures, and at least one faucet mounting aperture that is adapted to receive a fastener that is used to mount the faucet to said bracket, and said mounting bracket having a flange extending from a back surface of said mounting bracket;

wherein further comprising a raised portion that extends from said front surface around said at least one fluid inlet aperture;

a faucet having a housing that accommodates a fluid outlet, a faucet flange for supporting said faucet, and a fluid inlet tube, wherein said faucet flange abuts an outer surface of said raised portion, thereby providing a gap between said faucet flange and said front surface;

wherein said fluid inlet tube is received within said fluid inlet aperture;

a first face plate for engagement onto a first portion of said front surface;

a second face plate for engagement onto a second portion of said front surface, wherein said first face plate and said second face plate conceal said bracket when said bracket is associated with a building surface; and wherein said first face plate has a bottom edge and said second face plate has a top edge, said bottom edge and said top edge have interlocking profiles.

11. The wall faucet of claim 10, wherein said mounting bracket is incorporated within the thickness of said building surface.

12. The wall faucet of claim 10, wherein said first face plate and said second face plate each possess a beveled outer edge.

13. A system for mounting a faucet, comprising:

a mounting bracket having an upper edge, a lower edge, a left edge, and a right edge that define a front surface, said mounting bracket having at least one fluid inlet aperture that is adapted to accommodate a fluid inlet tube that is associated with said faucet, a plurality of bracket mounting apertures, and at least one faucet mounting aperture that is adapted to receive a fastener that is used to mount said faucet to said bracket, and said mounting bracket having a flange extending from a back surface of said mounting bracket;

a first face plate for engagement onto a first portion of said front surface;

a second face plate for engagement onto a second portion of said front surface, wherein said first face plate and said second face plate conceal said bracket when said bracket is associated with a building surface; and wherein said at least one faucet mounting aperture is associated with a boss that extends away from said front surface, said boss adapted to engage said flange of said faucet to space said faucet from said front surface.

14. A wall faucet associated with a building surface, comprising:

a mounting bracket having an upper edge, a lower edge, a left edge, and a right edge that define a front surface, said mounting bracket having at least one fluid inlet aperture that is adapted to accommodate a fluid inlet tube that is associated with said faucet, a plurality of bracket mounting apertures, and at least one faucet mounting aperture that is adapted to receive a fastener that is used to mount said faucet to said bracket, and said mounting bracket having a flange extending from a back surface of said mounting bracket;

wherein further comprising a raised portion that extends from said front surface around said at least one fluid inlet aperture;

a faucet having a housing that accommodates a fluid outlet, a faucet flange for supporting said faucet, and a fluid inlet tube, wherein said faucet flange abuts an outer surface of said raised portion, thereby providing a gap between said faucet flange and said front surface;

wherein said fluid inlet tube is received within said fluid inlet aperture;

a first face plate for engagement onto a first portion of said front surface;

a second face plate for engagement onto a second portion of said front surface, wherein said first face plate and said second face plate conceal said bracket when said bracket is associated with a building surface; and wherein said first face plate and said second face plate each possess a beveled outer edge.

* * * * *